US009003852B2

(12) United States Patent
Green et al.

(10) Patent No.: US 9,003,852 B2
(45) Date of Patent: Apr. 14, 2015

(54) SHEET METAL BLANK

(75) Inventors: Richard Green, Bristol (GB); Michael Annear, Bristol (GB)

(73) Assignee: Rolls-Royce PLC, London (GB)

( * ) Notice: Subject to any disclaimer, the term of this patent is extended or adjusted under 35 U.S.C. 154(b) by 1707 days.

(21) Appl. No.: 11/808,692

(22) Filed: Jun. 12, 2007

(65) Prior Publication Data

US 2008/0078227 A1 Apr. 3, 2008

(30) Foreign Application Priority Data

Sep. 29, 2006 (GB) ..... 0619361.9

(51) Int. Cl.

| | |
|---|---|
| ***F01D 25/24*** | (2006.01) |
| ***F23R 3/60*** | (2006.01) |
| ***F23R 3/00*** | (2006.01) |
| ***B21J 1/00*** | (2006.01) |

(52) U.S. Cl.

CPC . *F01D 25/24* (2013.01); *F23R 3/60* (2013.01); *F23R 3/002* (2013.01); *B21J 1/00* (2013.01); *F05D 2230/26* (2013.01)

(58) Field of Classification Search

CPC ..... B21J 1/00; F23R 3/60; F23R 3/002; F01D 25/24; F05D 2230/26

USPC ..... 428/577, 600; 72/379.2; 60/752, 755

See application file for complete search history.

(56) References Cited

U.S. PATENT DOCUMENTS

| | | | | |
|---|---|---|---|---|
| 4,502,809 | A | 3/1985 | Geary | |
| 4,699,567 | A * | 10/1987 | Stewart | 415/200 |
| 4,725,334 | A * | 2/1988 | Brimm | 228/152 |
| 5,413,456 | A * | 5/1995 | Kulak et al. | 415/9 |
| 5,605,438 | A * | 2/1997 | Burdgick et al. | 415/182.1 |
| 6,059,524 | A * | 5/2000 | Costa et al. | 415/9 |
| 6,497,105 | B1 * | 12/2002 | Stastny | 60/796 |
| 6,681,577 | B2 * | 1/2004 | Bolender et al. | 60/772 |
| 6,792,757 | B2 * | 9/2004 | Borns et al. | 60/752 |
| 7,093,470 | B2 * | 8/2006 | El-Soudani | 72/56 |
| 2003/0039510 | A1 * | 2/2003 | Kuan | 404/25 |

FOREIGN PATENT DOCUMENTS

| | | |
|---|---|---|
| GB | 1 095 376 | 12/1967 |
| GB | 1 176 053 | 1/1970 |
| GB | 1 211 313 | 11/1970 |
| GB | 1 303 573 | 1/1973 |
| GB | 1 548 704 | 7/1979 |
| GB | 2 110 306 A | 6/1983 |
| GB | 2 397 343 A | 7/2004 |

* cited by examiner

*Primary Examiner* — Shelley Self
*Assistant Examiner* — Mohammad I Yusuf
(74) *Attorney, Agent, or Firm* — Oliff PLC

(57) ABSTRACT

A sheet metal blank for the manufacture of a casing of a gas turbine engine comprising a sheet of substantially constant wall thickness and a raised or thicker region extending along substantially the full length of the sheet metal blank. A raised or thicker region is provided between edges of the sheet metal blank. The raised or thicker region comprises at least one boss and at least one ridge extending way from the or each boss.

16 Claims, 4 Drawing Sheets

SHEET METAL BLANK

BACKGROUND

The invention relates to a sheet metal blank.

In particular the invention relates to a casing made from a sheet metal blank.

Casings for gas turbine engines, for example compressor outer casings, combustor outer casings and turbine outer casings, are frequently made from castings or forgings which are then machined to the correct dimensions. Alternatively a casing may be fabricated from sheet metal, with end flanges and bosses being welded into place which are machined to final dimensions to interface with other components, to provide access to the engine when assembled, for the passage of pipes and services from the exterior of the interior of the engine (eg fuel pipes and cables) or to accept external fittings. Since the casings are typically very thin (perhaps only 1 to 5 mm thick) it is common for slight misalignments in the welding of the casing to result in damage to the casing. Modern engines frequently require a great many bosses on engine casings, and the consequential distortion due to welding at multiple locations can significantly affect the profile of the finished casing. Hence there is a high possibility of damage to the casing during the manufacturing process.

Hence a casing having the required number of features, strength and geometry which can be produced by a method resulting in less component rejections is highly desirable.

The production of the base casting, forging or sheet metal shell to which bosses are welded to is also a problematic process and results in many rejections, slowing the manufacturing process and increasing the over all cost of each component which is successfully produced.

Hence it is desirable that the base structure that each casing is formed from is as easily and cheaply produced as possible.

SUMMARY

According to a first aspect of the invention there is provided a sheet metal blank for the manufacture of a casing of a gas turbine engine, comprising a sheet of substantially constant wall thickness and at least one raised or thicker region extending along substantially the full length of the sheet metal blank, wherein at least one raised or thicker region is provided between edges of the sheet metal blank, said at least one raised or thicker region comprising at least one boss and at least one ridge extending away from the or each boss.

Thus the invention is a simple sheet metal structure from which the desired casing can be formed. It is advantageous to machine or otherwise form features of the finished product on sheet metal prior to forming into the final product shape as it is easier to machine a flat surface than, say, a curved surface. Machining a curved surface requires very close manufacturing tolerances to be observed and frequent base lining of machine tool co-ordinates to ensure correct positioning of the machine tool, which is not required to the same degree with machining a flat surface. Also if an error is made in machining the sheet metal then the cost of replacing the sheet metal is minimal compared to that of replacing a casting, forging or casing shell.

According to a second aspect of the invention there is provided a method of forming a casing comprising the steps of:

a) manufacturing a sheet metal blank as herein described having two sides and two ends;

b) deforming the sheet metal blank such that it is substantially circular in cross-section; and c) joining the sheet metal blank at its ends;

wherein the sheet metal blank is deformed by passing it along a series of rollers, the through path defined by the rollers being wider than the thickness of the sheet wall and narrower that the thickness of the at least one raised or thicker region. Thus when the sheet metal blank passes through the rollers, the rollers are always in contact with raised or thicker regions.

According to a second aspect of the invention there is provided a casing manufactured from a sheet metal blank herein described by a method of forming a casing as herein described.

BRIEF DESCRIPTION OF THE DRAWINGS

The invention will now be described by way of example only with reference to the accompanying drawings in which.

DETAILED DESCRIPTION OF EMBODIMENTS

Figure 1:
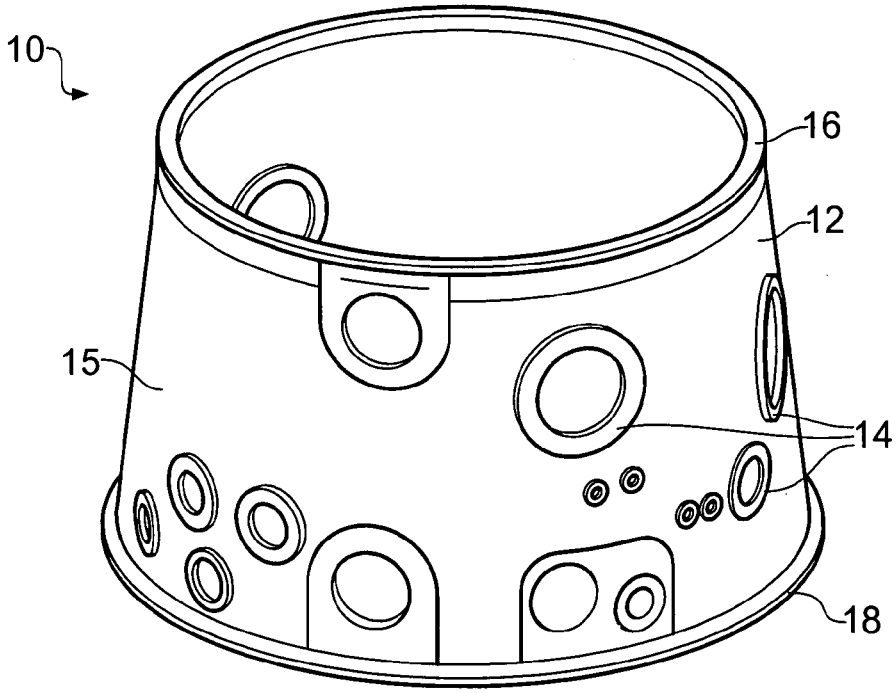
Fig. 1(PRIOR ART)
FIG. 1 shows a perspective view of a known casing (PRIOR ART)

Presented in FIG. 1 (PRIOR ART) is a perspective view of a known casing 10. The casing 10 is frusto conical and may form an outer casing for a compressor or turbine module (not shown). The casing 10 is defined by a wall 12 which has a substantially constant thickness. The wall 12 is provided with a number of bosses 14 over its outer surface 15, the bosses 14 being raised from the surface 15 such that the overall thickness of the casing 10 where a boss 14 is present is greater than the thickness of the wall 15. Flanges 16,18 are provided at either end of the casing 10 for attachment to engine components upstream and downstream of the casing. The casing 10 may have been produced from a casting, or perhaps a forging where the bosses 14 and flanges 16, 18 have been machined to their final dimensions. Alternatively it may have been produced from a plain sheet metal casing with bosses 14 welded into place on the surface 15.

Figure 2:
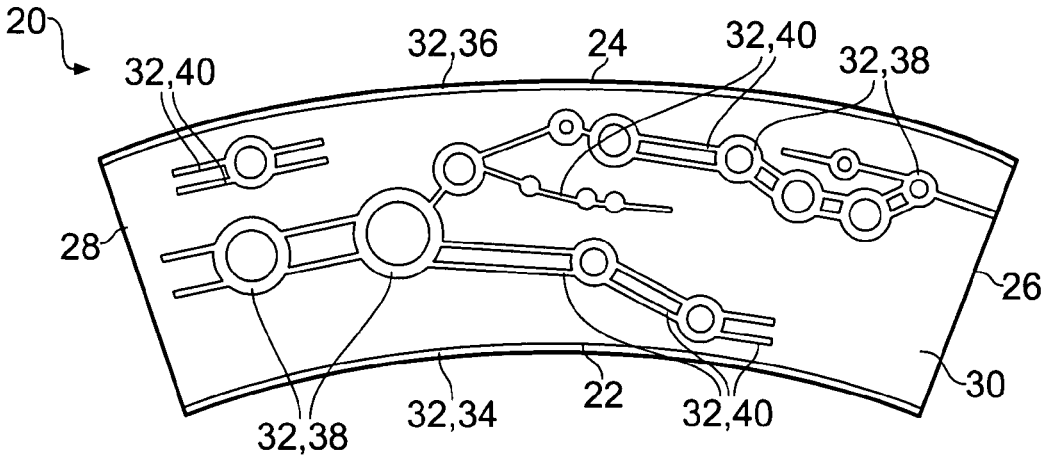
FIG. 2 shows a plan view of a sheet metal blank according to the present invention.

In contrast the casing of the present invention is formed from a sheet metal blank 20 as shown in FIG. 2. The blank 20 is in the form of a sector of a ring. That is to say it has a two curved parallel sides 22, 24 and two ends 26, 28 which are at an angle to one another but which both are perpendicular to a tangent at their junction with the curved sides 22, 24 of the blank 20. The blank 20 is formed from a sheet of metal of substantially constant wall thickness, which is then machined, chemical etched, forged, pressed or otherwise formed such that the resultant blank 20 has a wall 30 of substantially constant thickness and at least one raised or thicker region 32 extending along substantially the full length of the sheet metal blank 20. In the embodiment shown flanges 34, 36 are provided along both edges of the sheet metal blank form part for the raised/thicker region 32. Further raised regions 32 are provided between edges 24, 26 of the sheet metal blank 20 in the form of bosses 38, and ridges 40, where the ridges 40 extend away from each of the bosses 38 and/or link bosses 38.

The wall 30 has a thickness greater than 0.7 mm but not greater than 5 mm, and the raised regions 32 have a thickness no greater than twice the thickness of the wall 30. The thicker regions 32 have substantially constant thickness along the full length of the blank. The bosses 38 and ridges 40 extends from one side of the wall 30 sheet metal blank, and the other side of the sheet metal blank wall 30 is planar. The sheet metal blank 20, 80 is preferably made from titanium.

As shown in FIG. 2, the bosses 38 may be linked to other bosses 38 by the ridges 40. Alternatively bosses may be provided in isolation with ridges 40 extending away from them for a distance. However, at all points along the length of the blank 20 there is at least one feature 32 which is raised above the wall surface 30.

In the region where the ridges 40 meet the bosses 38, the ridges 40 splay out so as to provide a lead in to the bosses 38. That is to say, the ridges 40 run onto the crown of the bosses 38 such that the there is a gradual change in width of the raised feature 32 in the transition between the ridge 40 and the bosses 38.

Figure 3:
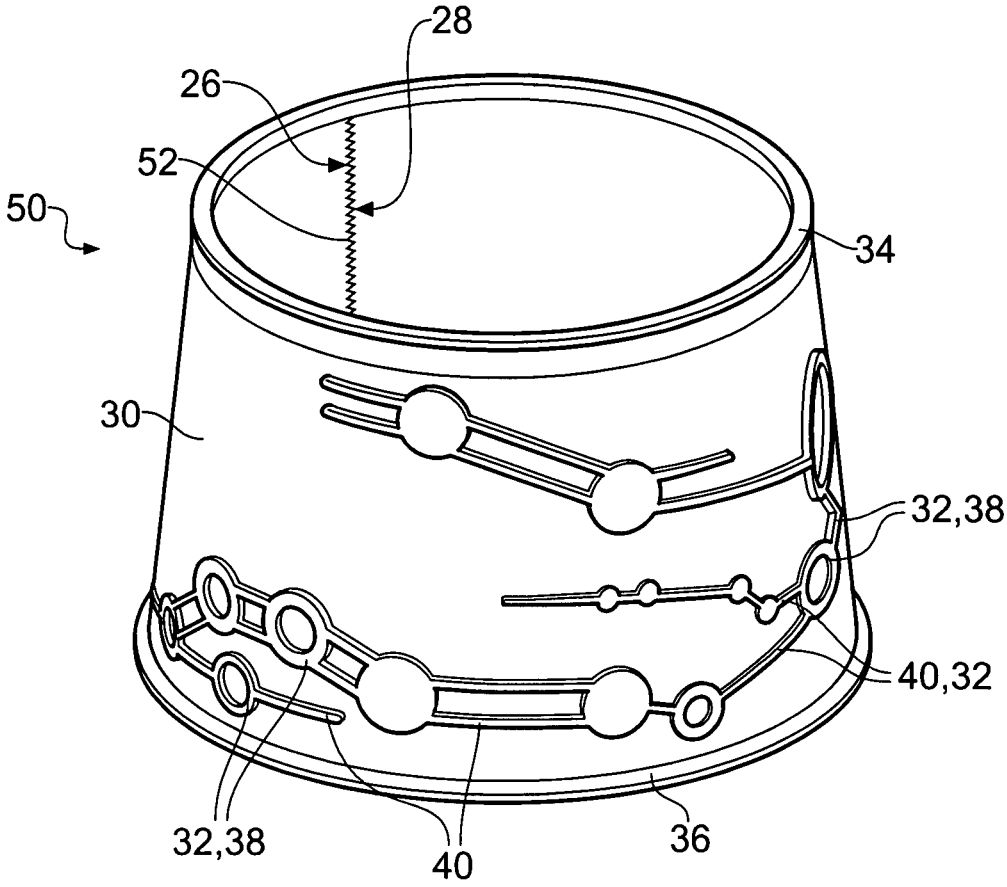
FIG. 3 shows a perspective view of a casing according to the present invention.

FIG. 3 shows a casing 50 formed from the sheet metal blank 20 of FIG. 2. The blank 20 is deformed such that it is substantially circular in cross-section and then joined at the ends 26, 28 to form the frusto conical casing 50. The sheet metal blank 20 is joined at ends 26, 28 by a weld 52.

Figure 4:
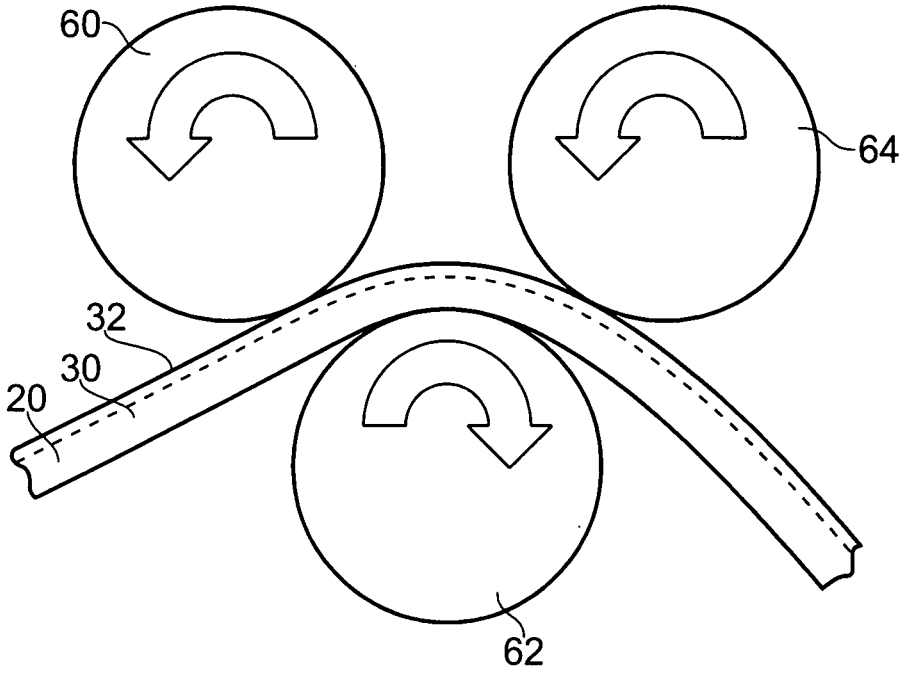
FIG. 4 shows a known rolling arrangement for bending the blank of the present invention.

The sheet metal blank 20 is deformed by a process known as rolling, as illustrated in FIG. 4, in which the blank 20 is passed along a series of rollers 60, 62, 64, the through path defined by the rollers 60, 62, 64 being wider than the thickness of the wall 30 of the sheet 20 (shown as a dotted line in FIG. 4), but narrower than the thickness of the thicker region 32. The distance between the rollers 60, 62, 64 is fixed during the rolling operation, hence the rollers 60, 62, 64 do not contact the metal blank 20 at its thinnest regions on both sides of wall 30. The raised regions 32 (that is to say, the ridges 40 extending away from and between the bosses 38 and/or the flanges 34, 36) ensure the sheet metal blank 20 is in contact with the rollers 60, 62, 64 throughout the bending process such that the sheet metal blank 20 is bent along substantially its full length to form an arcuate sheet. The arcuate sheet is then is joined at its ends 26, 28 to form a casing 50 with a substantially circular cross section.

Figure 5:
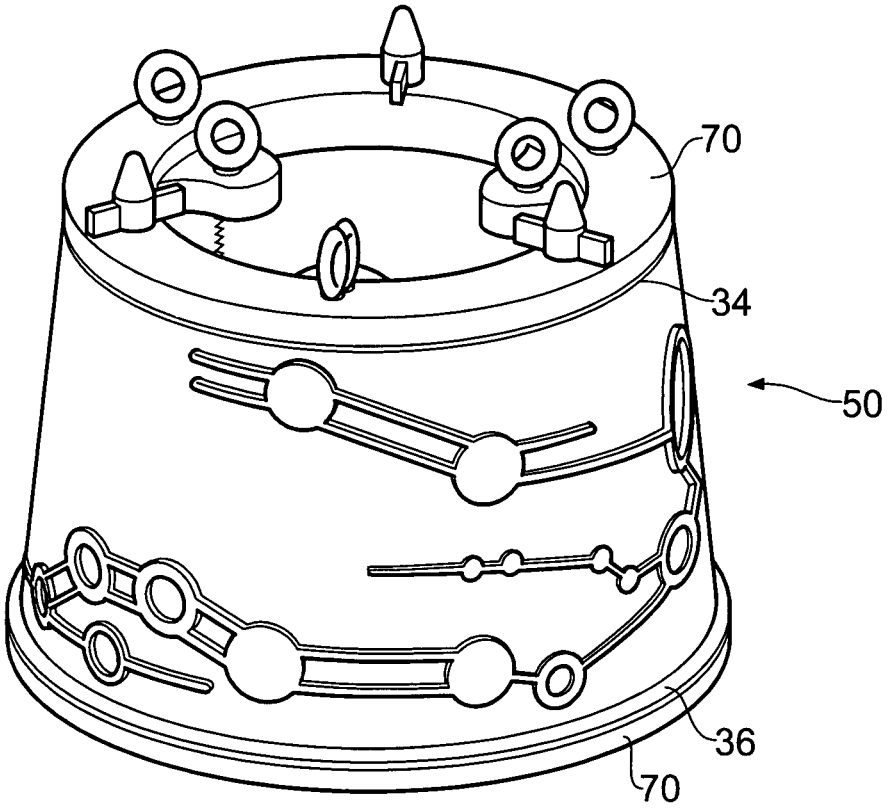
FIG. 5 shows the casing in position on a sizing tool.

As shown in FIG. 5 the casing 50 may then optionally be further formed by being placed on a jig 70 and stretched either expansion of the jig and/or by being forced down the conical surface of the jig 70. Such stretching enables the final dimensions of the casing 50 to achieved. That is to say, after the ends 26, 28 are joined the casing 50 may not have the desired cross section at all points along its length, and the optional stretching step will ensure the design dimensions are achieved. Some or all of the bosses 38 may then be machined to produce a flat location surface.

Figure 6:
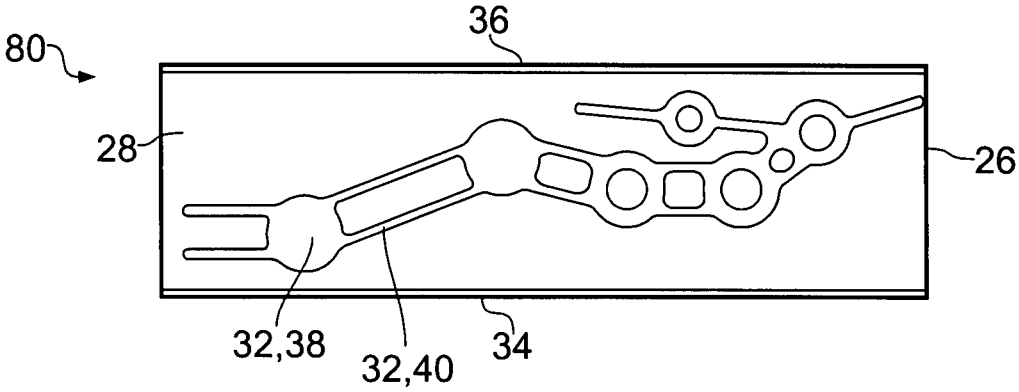
FIG. 6 shows a plan view of an alternative embodiment of a sheet metal blank according to the present invention.

In an alternative embodiment, where a cylindrical rather than frusto-conical casing is required, a rectangular sheet metal blank 80, as shown in FIG. 6, may be produced rather than the arcuate blank 20 shown in FIG. 2. Other than the rectangular shape, features of the blank 80 and method of manufacture of the blank and resultant casing are common to the blank 20.

In the embodiments herein described the blank 20, 80 and casing 50 are described as having a plurality of bosses 38 and ridges 40. However, in an application where bosses are not required, only ridges and/or a flange extending along the full length of the blank 28, 80 are provided. Alternatively a blank 20, 80 may be provided with a single boss 38 and/or a single ridge 40 extending away from the boss 38.

The raised region 32 extends substantially along the full length of the sheet metal blank 20, 80. However, lead in features at the ends 26, 28 of the blank 20, 80 may be provided which have either no raised region 32, or a tapered raised region. These will help to feed the blank into to rolling/bending device.

The splayed ends of the ridges 40 in the transition region between the ridges 40 and the bosses 38 also act as a lead in for each boss 38 between the rollers (60, 62, 64), thus reducing the occurrence of an uneven residual stress in the region of the boss 38 when bent.

In the embodiment described above, the casing is manufactured from one piece of sheet metal. In an alternative embodiment, the casing is made from two or more deformed sheet metal blanks, which are then joined together to form one substantially cylindrical or frusto-conical shape.

The method of deforming the sheet metal blank such that it is substantially arcuate or circular in cross section may be achieved by use of a press brake rather than by rolling.

Reference is hereinbefore made to sheet metal, where a "sheet" is intended to described a material provided in a substantially flat and plane form. In this context "sheet metal" is exchangeable with "plate metal", another term of the art, which is indicative of a material which is provided in a thicker form than a "sheet".

The raised or thicker regions 32 have a width of no less than 7 mm. In a titanium alloy casing this has been shown to distribute stress around the features of the thicker region to within optimal limits.

Providing a casing with thicker/raised regions extending between bosses is counterintuitive, as it will be appreciated that ordinarily such features act as stress concentration features. It is only with careful positioning, sizing and shaping that the raised features can be "tuned" to produce a structure which is more rigid than that of the prior art (since the thicker/raised regions stiffen the casing) and which results in a component with stress concentrations that are within acceptable limits.

The invention claimed is:

1. A sheet metal blank for manufacturing a casing of a gas turbine engine, the sheet metal blank comprising:

a metal sheet of substantially constant wall thickness; and at least one raised or thicker region protruding from the sheet along substantially a full length of the sheet, wherein the at least one raised or thicker region is provided between edges of the sheet, the at least one raised or thicker region comprises two or more bosses and at least one ridge connecting two of the bosses, and the blank is adapted to be rolled to form a casing of a gas turbine engine.

2. The sheet metal blank as claimed in claim 1 further comprising a further raised or thicker region comprising a flange along at least one of the edges of the sheet.

3. The sheet metal blank as claimed in claim 1 wherein the sheet metal blank is substantially rectangular.

4. The sheet metal blank as claimed in claim 1 wherein the sheet metal blank is in a form of a sector of a ring.

5. The sheet metal blank as claimed in claim 1 wherein the wall thickness of the sheet is greater than 0.7 mm but not greater than 5 mm.

6. The sheet metal blank as claimed in claim 1 wherein the at least one raised or thicker region has a thickness no greater than twice the wall thickness of the sheet.

7. The sheet metal blank as claimed in claim 1 wherein the at least one raised or thicker region has a width no less than 7 mm.

8. The sheet metal blank as claimed in claim 1 wherein the at least one raised or thicker region protrudes from one side of the sheet, and an other side of the sheet metal blank is planar.

9. The sheet metal blank as claimed in claim 1 wherein the at least one raised or thicker region has a substantially constant wall thickness along the full length of the sheet.

10. A method of forming a casing comprising:

a) manufacturing a sheet metal blank comprising:

two sides and two ends;

a metal sheet of substantially constant wall thickness; and at least one raised or thicker region protruding from the sheet along substantially a full length of the sheet, wherein the at least one raised or thicker region is provided between edges of the sheet, the at least one raised or thicker region comprising two or more bosses and at least one ridge connecting two of the bosses;

b) deforming the sheet metal blank to be substantially circular in cross-section; and c) welding the sheet metal blank at the two ends;

wherein the sheet metal blank is deformed by passing the sheet metal blank along a series of rollers, a through path defined by the rollers being wider than the wall thickness of the metal sheet and narrower than a thickness of the at least one raised or thicker region, to form a casing of a gas turbine engine.

11. The method of forming a casing as claimed in claim 10 wherein the at least one raised or thicker region is formed by machining and/or chemical etching material from the sheet metal blank.

12. The method of forming a casing as claimed in claim 10 further comprising deforming the casing on a sizing tool.

13. The sheet metal blank as claimed in claim 1, wherein there is a gradual change in width in a transition between the at least one ridge and the at least one boss.

14. The sheet metal blank as claimed in claim 1, wherein the at least one boss is a cylindrical boss.

15. The sheet metal blank as claimed in claim 14, comprising a plurality of bosses, wherein a diameter of at least one of the bosses is different from a diameter of another one of the bosses.

16. The sheet metal blank as claimed in claim 1, further comprising a plurality of bosses of varying sizes.

* * * * *